US008640600B2

(12) United States Patent
Chung

(10) Patent No.: US 8,640,600 B2
(45) Date of Patent: Feb. 4, 2014

(54) HYDRAULIC CYLINDER CUSHION DEVICE WITH CHECK RING

(75) Inventor: Yun Hyun Chung, Changwon-si (KR)

(73) Assignee: Volvo Construction Equipment Holding Sweden AB, Eskilstuna (SE)

( * ) Notice: Subject to any disclaimer, the term of this patent is extended or adjusted under 35 U.S.C. 154(b) by 654 days.

(21) Appl. No.: 12/908,062

(22) Filed: Oct. 20, 2010

(65) Prior Publication Data

US 2011/0094374 A1 Apr. 28, 2011

(30) Foreign Application Priority Data

Oct. 28, 2009 (KR) ..... 10-2009-0102767

(51) Int. Cl.
*F15B 15/22* (2006.01)

(52) U.S. Cl.
USPC ..... 91/395; 91/396

(58) Field of Classification Search
USPC ..... 91/394, 395, 396, 405, 406
See application file for complete search history.

(56) References Cited

U.S. PATENT DOCUMENTS 4,458,717 A * 7/1984 Boland ..... 91/396
4,862,786 A * 9/1989 Boyer et al. ..... 91/396

* cited by examiner

*Primary Examiner* — Michael Leslie
(74) *Attorney, Agent, or Firm* — Ladas & Parry LLP

(57) ABSTRACT

A hydraulic cylinder cushion device installed in a hydraulic cylinder provided, in which a rod performs reciprocating movement in a cylinder tube, and which discharges high-pressure hydraulic fluid that is formed in pressure chambers between a piston and a head cover and between the piston and a cover end during a stroke-end operation. The hydraulic cylinder cushion device includes a check ring which is installed in a groove provided on an inner surface of the head cover or the cover end, and moves to one side in the groove so as to close a flow path during rushing into a stroke end while it moves to the other side in the groove so as to open the flow path during an initial operation in the stroke end.

3 Claims, 6 Drawing Sheets

HYDRAULIC CYLINDER CUSHION DEVICE WITH CHECK RING

CROSS-REFERENCE TO RELATED APPLICATION

This application is based on and claims priority from Korean Patent Application No. 10-2009-102767, filed on Oct. 28, 2009 in the Korean Intellectual Property Office, the disclosure of which is incorporated herein in its entirety by reference.

BACKGROUND OF THE INVENTION

1. Field of the Invention

The present invention relates to a hydraulic cylinder cushion device, and more particularly to a hydraulic cylinder cushion device that improves the cushion performance at a stroke end by a check ring.

2. Description of the Prior Art

FIGS. 1A to 1C are views illustrating an example of a hydraulic pneumatic cylinder in the related art. As shown in FIG. 1A, a cylinder briefly includes a tube 10 which serves as a pressure vessel and guides a rectilinear movement of a piston, a rod 20 which is a long circular bar shaped shaft portion that performs a rectilinear reciprocating movement; a head cover 30 having a packing mounted thereon to prevent outer leakage of hydraulic fluid in the tube; a piston which maintains hydraulic power in a large chamber and a small chamber provided in the tube; and a cushion ring 50 which absorbs mechanical impact at a stroke end.

FIG. 1B is a view exemplifying a state where a cushion ring 5 rushes into head cover 30, and FIG. 1C is a view exemplifying a time point where an initial operation starts on the opposite side after the entrance of the cushion ring is completed.

In the case of a cylinder with built-in cushion, as shown in FIGS. 1A to 1C, a cushion system is constructed to reduce the mechanical impact in a stroke end, and most approaching schemes are to construct a structure that reduces impact force through reduction of the speed of a piston 40. The speed of the piston 40 is reduced by gradually throttling a flow path through adjustment of an open area on an outlet flow path using a ring type or plunger type cushion system.

As illustrated in FIG. 1C, at the time point where the cushion tool's rushing into the stroke end is almost completed, a gap is kept in a minimum state for sufficient cushion, and the mutual contact surfaces of an end portion and an outer peripheral portion are in mutually strong surface contact with each other.

If the cushion gets out of the stroke end, an additional frictional force is formed, and a cross-sectional area for actually transferring the cylinder rod, although the hydraulic fluid has been transferred from the pump to the flow path, is formed only by the ring-shaped projection area of the cushion ring, which is too narrow. Accordingly, a time delay occurs until the pressure is accumulated and a sufficient force is formed.

According to some cylinders in the market, as shown in FIG. 2, a cushion chamber is inserted into the lower end of the cushion ring to lead the check function. In this case, however, since a groove process is performed with respect to one end of the rod, which copes with a relatively great force and is exposed at all times, there is possibility of damage due to the stress concentration.

From the viewpoint of the hydraulic system, as shown in FIG. 3, when the cylinder is initially operated at the stroke end, the operation of the discharge side of the pump is delayed due to the insufficiency of a pressed area in the cylinder, and thus the pressure is increased. Sometimes, the increased pressure reaches the relief pressure, and this cause unnecessary energy consumption. From the viewpoint of the cylinder operation, an instantaneous initial abrupt operation or the like occurs after the operation delay, and this causes a deathblow to the performance of the cylinder in the case where an elaborate work is required.

In addition, the above-described phenomenon aggravates fuel economy of the equipment due to the unnecessary energy consumption, and in order to give smooth initial operability, the phenomenon causes a system overdesign element such as an increase of pump capacity or the like to increase the cost.

SUMMARY OF THE INVENTION

Accordingly, the present invention has been made to solve the above-mentioned problems occurring in the prior art while advantages achieved by the prior art are maintained intact.

An embodiment of the present invention relates to an improvement of the cushion performance by forming a check ring.

In one aspect of the present invention, there is provided a hydraulic cylinder cushion device installed in a hydraulic cylinder, in which a rod performs reciprocating movement in a cylinder tube and which discharges high-pressure hydraulic fluid that is formed in pressure chambers between a piston and a head cover and between the piston and a cover end during a stroke-end operation, which includes a check ring which is installed in a groove provided on an inner surface of the head cover or the cover end, and moves to one side in the groove so as to close a flow path during rushing into a stroke end while it moves to the other side in the groove so as to open the flow path during an initial operation in the stroke end.

The hydraulic cylinder cushion device as constructed above according to an embodiment of the present invention has the following advantages.

First, the check ring is formed, and thus the operation delay in the stroke end and the initial abrupt operation can be prevented.

Second, since the excessive pressure increase of the pump due to the operation delay in the stroke end can be prevented, the pump efficiency is heightened.

Third, since the check ring is applied, the cushion function is additionally improved during the entrance into the stroke end, the excessive operation of the pump is prevented, and the operation delay is improved to heighten the fuel efficiency with the cost saved.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Figure 1A:
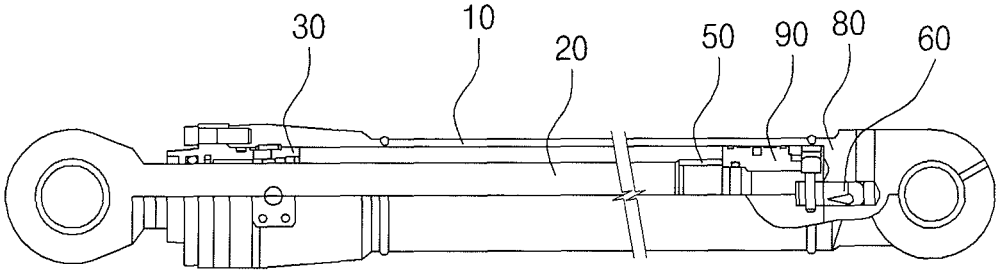
FIG. 1A PRIOR ART
FIGS. 1A to 1C are cross-sectional views illustrating a hydraulic cylinder cushion device in the related art, a state where a cushion ring in the related art rushes into a stroke end, and a state during the initial operation at the stroke end, respectively.

Hereinafter, a hydraulic cylinder cushion device according to preferred embodiments of the present invention will be described with reference to the accompanying drawings. In the drawings, thicknesses of lines, sizes of the constituent elements, or the like may be exaggerated for clarity in explanation.

Also, the spatially defined wordings in consideration of the functions of the present invention may differ in accordance with a user's or operator's intention or custom, and the definition of such wordings should be made based on the contents throughout the entire description of the present invention.

In addition, the matters defined in the description, such as the detailed construction and elements, are nothing but specific details provided to assist those of ordinary skill in the art in a comprehensive understanding of the invention, and thus the embodiments including constituent elements which are included in the entire description of the present invention and are replaceable as equivalents of the constituent elements in the claims may be included in the scope of the present invention.

Figure 1B:
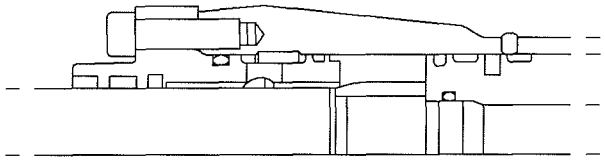
FIG. 1B PRIOR ART
Figure 1C:
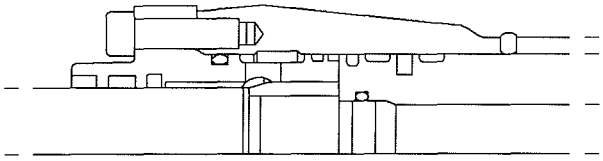
FIG. 1C PRIOR ART
Figure 2:
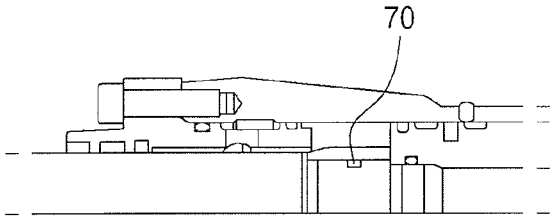
FIG. 2 PRIOR ART
FIG. 2 is a cross-sectional view illustrating a hydraulic cylinder cushion device with a cushion chamber in the related art.
Figure 3:
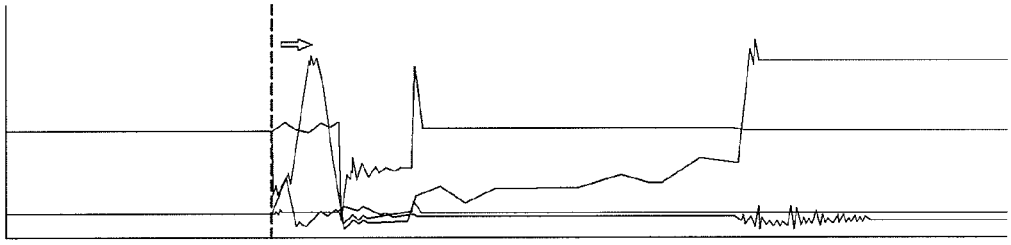
FIG. 3 PRIOR ART
FIG. 3 is a diagram illustrating a pressure profile of a hydraulic cylinder cushion device in the related art during an initial operation in a stroke end, which shows the discharge pressure of a hydraulic pump during an initial operation of the hydraulic cylinder.
Figure 4A:
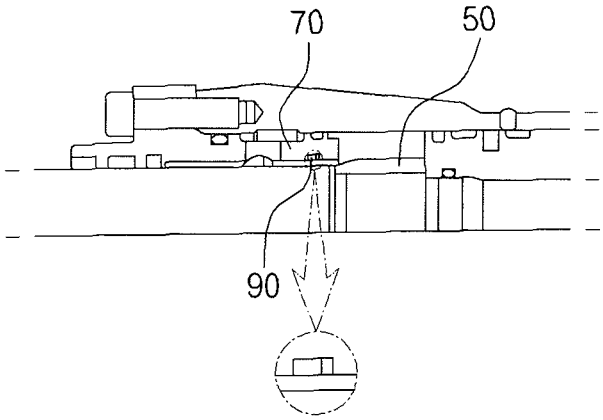
FIGS. 4A and 4B are cross-sectional views illustrating a hydraulic cylinder cushion device according to an embodiment of the present invention.
Figure 4B:
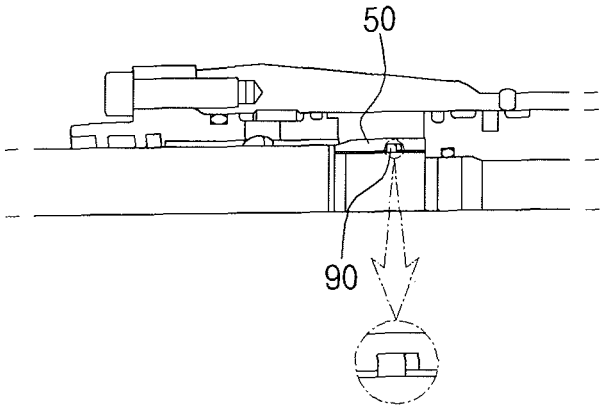
Figure 5A:
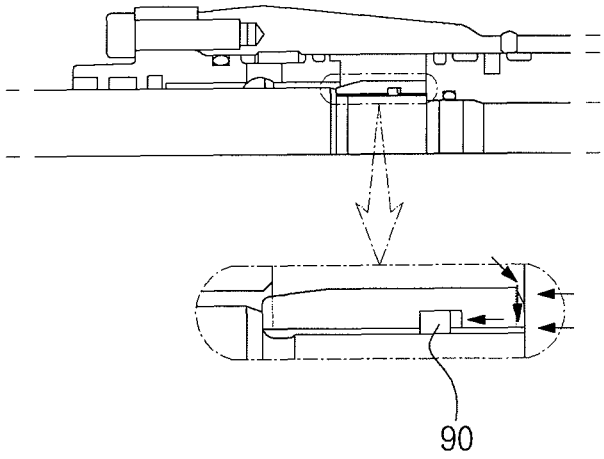
FIGS. 5A and 5B are cross-sectional views illustrating the detailed structure of the hydraulic cylinder cushion device as illustrated in FIGS. 4A and 4B.
Figure 5B:
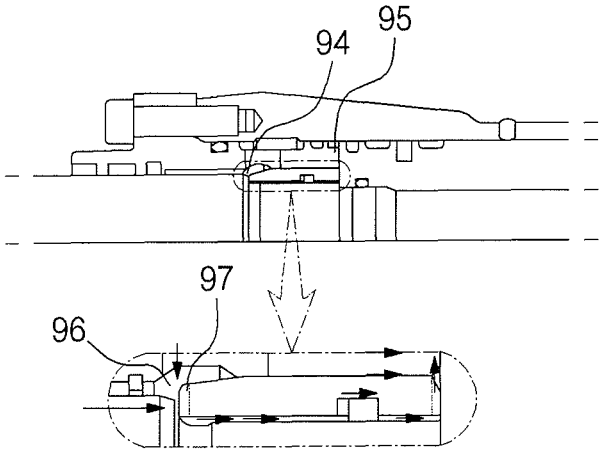

FIGS. 1A to 1C are cross-sectional views illustrating a hydraulic cylinder cushion device in the related art, a state where a cushion ring in the related art rushes into a stroke end, and a state during the initial operation at the stroke end, respectively. FIG. 2 is a cross-sectional view illustrating a hydraulic cylinder cushion device with a cushion chamber in the related art, and FIG. 3 is a diagram illustrating a pressure profile of a hydraulic cylinder cushion device in the related art during an initial operation in a stroke end, which shows the discharge pressure of a hydraulic pump during an initial operation of the hydraulic cylinder. FIGS. 4A and 4B are cross-sectional views illustrating a hydraulic cylinder cushion device according to an embodiment of the present invention. FIGS. 5A and 5B are cross-sectional views illustrating the detailed structure of the hydraulic cylinder cushion device as illustrated in FIGS. 4A and 4B, and FIGS. 6A to 6C are perspective views and a cross-sectional view illustrating a check ring of the hydraulic cylinder cushion device as illustrated in FIGS. 4A and 4B.

According to a preferred embodiment of the present invention, a hydraulic cylinder cushion device installed in a hydraulic cylinder, in which a rod 20 performs reciprocating movement in a cylinder tube 10 and which discharges high-pressure hydraulic fluid that is formed in pressure chambers between a piston 40 and a head cover 30 and between the piston 40 and a cover end during a stroke-end operation, includes a check ring which is installed in a groove provided on an inner surface of the head cover 30 or the cover end, and moves to one side in the groove so as to close a flow path during rushing into a stroke end while it moves to the other side in the groove so as to open the flow path during an initial operation in the stroke end.

The tube 10 is a portion that forms the outer wall of the cylinder. Since the tube 10 guides the movement of the piston 40, the piston 40 slides on the tube, and since an internal pressure is applied thereon, pressure resistance and abrasion resistance are required. In order to heighten the mechanical performance as described above, the inner surface of the tube 10 is smoothed with a surface roughness below 1.6 S. Generally, as a material of the tube 10, aluminum, rolled steel for machine structural purposes, brass tube, or the like, has been used. Recently, a stainless steel tube or a plastic tube is used for a small cylinder.

Since the rod 20 requires strength and abrasion resistance enough to endure load, such as tensile, compression, bending, vibration, and the like, according to an acting load, it may be made of a hard chromium plated steel machine carbon to improve the corrosion resistance and abrasion resistance, and for special purposes, it may be made of stainless steel series.

Since the hydraulic cylinder used in heavy equipment moves large mass load, the piston 40 may collide with the head cover 30 to generate mechanical shock during the stroke-end operation. In order to mitigate such shock and to smoothly operate the cylinder at high speed and with a large load, a hydraulic cylinder cushion device is required.

The hydraulic cylinder cushion device absorbs shock occurring when the piston 40 and the head cover 30 collide with each other, lengthens the life span of the hydraulic cylinder, and prevents the damage of appliances or tubes of a hydraulic device due to vibration generated caused by the shock and so on.

As illustrated in FIGS. 1A to 1C and 3, the hydraulic cylinder cushion device in the related art has the problem that the time delay and the excessive pressure increase due to the time delay occur during the initial operation in the stroke end.

As illustrated in FIG. 4, the hydraulic cylinder cushion device according to an embodiment of the present invention includes a check ring 90. The check ring 90 is installed in a groove provided on an inner surface of the head cover 30 or the cover end 80, and is relatively movable in the groove.

The check ring 90 performs a check function for opening and closing the flow path in a manner that it relatively moves to one side in the groove so that a flow path is closed during rushing into the stroke end, and moves to the other side in the groove so that the flow path is opened during an initial operation in the stroke end.

In the hydraulic cylinder cushion device according to a preferred embodiment of the present invention, the check ring 90 is installed in the groove provided on the inner surface of the head cover 30 or the cover end 80.

In FIG. 4A, the check ring 90 is formed in the groove provided on the inner surface of the head cover 30. In the same manner, the check ring 90 may be formed in the groove provided on the inner surface of the cover end 80, or may be formed in the grooves provided on the inner surfaces of the head cover 30 and the cover end 80, respectively. In this case, the operation delay and the pump pressure increase can be prevented during the initial operation at the stroke end of both the head cover 30 and the cover end 80.

According to another preferred embodiment of the present invention, a hydraulic cylinder cushion device installed in a hydraulic cylinder, in which a rod 20 performs reciprocating movement in a cylinder tube 10 and which discharges high-pressure hydraulic fluid that is formed in pressure chambers between a piston 40 and a head cover 30 and between the piston 40 and a cover end during a stroke-end operation, includes a check ring which is installed in a groove provided on an inner surface of a cushion ring 50 that is provided on an outer surface of the rod 20 or a groove provided on an outer surface of a cushion plunger 60 that is inserted into one end of the rod end 20 on the side of the cover end 80, and moves to one side in the groove so as to close a flow path during rushing into a stroke end while it moves to the other side in the groove so as to open the flow path during an initial operation in the stroke end.

As illustrated in FIGS. 1A to 1C, in order to absorb the mechanical impact in the stroke end, the cushion ring 50 is provided on the outer surface of the rod 20, and the cushion plunger 60 is inserted into one end of the rod 20.

It is also possible that the check ring 90 is installed on the cushion ring 50 or the cushion plunger 60 instead of the head cover 30 or the cover end 80. FIG. 4B shows a state where the check ring 90 is formed on the cushion ring 50.

The detailed structure of FIG. 4B is shown in FIGS. 5A and 5B. As shown in FIG. 5A, when the cushion ring 50 rushes into the stroke end, the cushion pressure according to the flow path throttling pushes the rear surface of the cushion ring 50, and thus the cushion ring 50 reaches the check ring 90 through a gap produced by the pushing operation and a slot formed on the rear surface of the cushion ring 50. However, after the cushion ring 50 reaches the check ring 90, the flow path is closed by the function of the check ring 90 and thus a sufficient cushion can be maintained.

By contrast, in the case where the cushion ring 50 gets out of the stroke end as illustrated in FIG. 5B, the cushion ring 50 is pushed as far as the designed gap by inflow pressure, and hydraulic fluid discharged from the pump flows through the gap 96 and an orifice or a slot 97 in the front end portion of the cushion ring 50 to reach the check ring 90 through the inner gap of the cushion ring 50.

At that time, the check ring 90 is pushed, and a flow path is connected up to the slot 97 on the rear surface of the cushion ring 50 along a path formed in an outer periphery or inner periphery 91 of the check ring 90. The fluid, having passed through the flow path, forms pressed hydraulic fluid on the front surface of the piston 40 to greatly increase the initial pressed area, and thus by adding an area 95 in addition to the area 94 on which the actual hydraulic pressure acts, smooth movement becomes possible without any initial operation delay.

In the hydraulic cylinder cushion device according to a preferred embodiment of the present invention, the check ring 90 is formed in a groove provided on the inner surface of the cushion ring 50 provided on the outer surface of the rod 20 and the outer surface of the cushion plunger 60 that is inserted into one end of the rod 20 on the side of the cover end 80.

FIG. 4B shows a state where the check ring 90 is formed in the groove provided on the inner surface of the cushion ring 50. In the same manner, the check ring 90 may be formed in the groove provided on the outer surface of the cushion plunger 60, and also may be formed in the groove provided on the inner surface of the cushion ring 50 and the groove provided on the outer surface of the cushion plunger 60, respectively. In this case, since the check ring 90 performs the check function for controlling inflow and outflow of the hydraulic fluid as relatively moving in the groove, the operation delay and the pump pressure increase can be prevented during the initial operation at the stroke end of both the head cover 30 and the cover end 80.

In the hydraulic cylinder cushion device according to the preferred embodiment of the present invention, the check ring 90 may be formed in the groove provided on the inner surface of the head cover 30 and in the groove provided on the outer surface of the cushion plunger 60 that is inserted into one end of the rod 20 on the side of the cover end 80, or may be formed in the groove provided on the inner surface of the cushion ring 50 provided on the outer surface of the rod 20 and in the groove provided on the outer surface of the cushion plunger 60 that is inserted into one end of the rod 20 on the side of the cover end 80.

The check ring 90 may be installed on the head cover 30 and the cover end 80, on the head cover 30 and the cushion plunger 60 instead of the cushion ring 50 and the cushion plunger 60, or on the cushion ring 50 and the end cover, respectively.

In the hydraulic cylinder cushion device according to the preferred embodiment of the present invention, the check ring 90 includes an inner peripheral surface 91 on which a plurality of first grooves 91*a* are formed in forward and backward directions; a sealing surface 92 evenly formed to perform surface contact; and a step surface 93 on which a plurality of second grooves 93*a* are formed in a radial direction and which has steps formed on an opposite side of the sealing surface 92; wherein during rushing into the stroke end, the sealing surface 92 moves on one side of the groove to close a flow path, and during an initial operation, the step surface 93 moves to the other side of the groove to open the flow path.

Figure 6A:
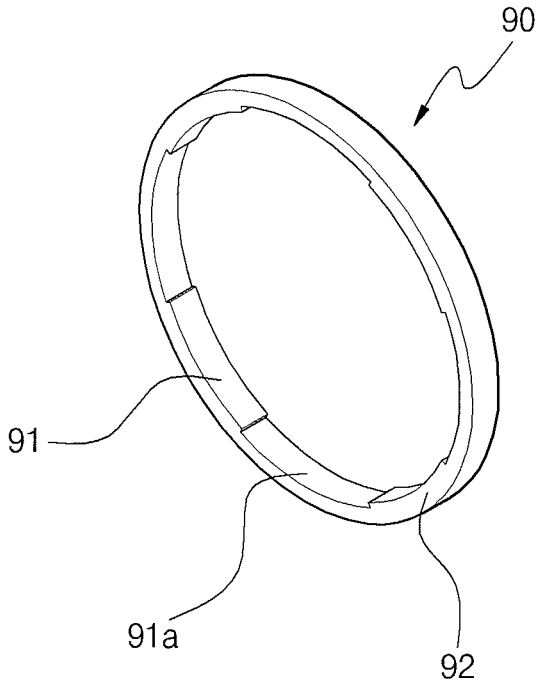
FIGS. 6A to 6C are perspective views and a cross-sectional view illustrating a check ring of the hydraulic cylinder cushion device as illustrated in FIGS. 4A and 4B.
Figure 6B:
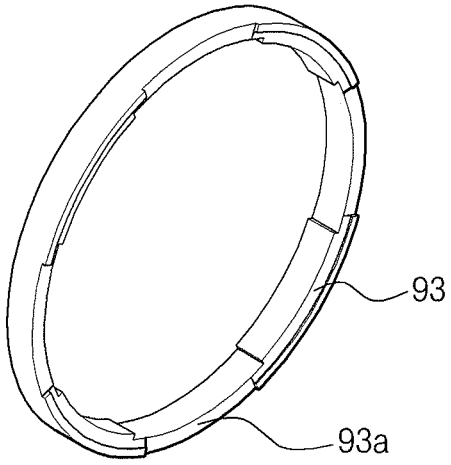
Figure 6C:
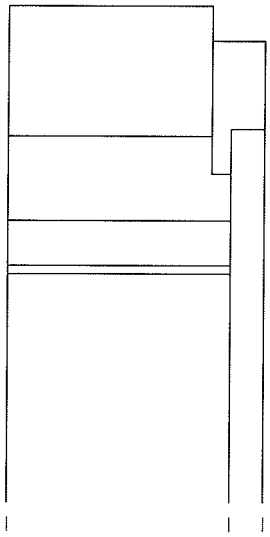

As illustrated in FIGS. 6A to 6C, the check ring 90 includes the inner peripheral surface 91, the sealing surface 92, and the step surface 93. On the inner peripheral surface 91, a plurality of first grooves 91*a* are formed, and in FIGS. 6A to 6C, four first grooves 91*a* are formed. The sealing surface 92 corresponds to one side surface of the check ring 90, and means a left side surface evenly formed to perform surface contact.

The step surface 93 corresponds to the other side surface except for the sealing surface 92. On the step surface 92, a plurality of second grooves 93*a* are formed, and in FIGS. 6A to 6C, four second grooves 93*a* are formed. Also, the step surface has steps formed thereon, and thus cannot perform the surface contact, unlike the sealing surface 92, to form a flow path.

During the rushing into the stroke end, the sealing surface 92 moves on one side of the groove to close the flow path. By contrast, during the initial operation, the step surface 93 moves to the other side of the groove, and thus cannot perform the surface contact. In this case, the hydraulic fluid flowing in through the first grooves 91*a* can move in the radial direction of the step surface 93 and through the second grooves 93*a*, and thus the flow path is opened.

Although the sealing surface 92 is formed to have a flat structure that leads the surface contact to close the flow path, the inner peripheral surface 91 or the outer peripheral surface thereof is processed in the form of a slot, a notch, or an orifice so as to form a flow path according to the mount structure thereof. The step surface 93 may be diversely formed as a structure in which the flow path through the inner peripheral surface 91 or the outer peripheral surface is connected to the front end of the piston 40 without discontinuation to apply an additional hydraulic pressure.

The check ring 90 may be made of diverse materials including case iron series, alloy series, Teflon series, nylon series, resin series, urethane series, and other rubber series, and may be in the form of a circle as illustrated in FIGS. 6A to 6C.

Preferably, the front/rear surfaces and the inner/outer peripheral surfaces should be processed to satisfy the required sealing characteristics and the flow path opening characteristics, and the formed flow path should have a proper function and a preset life span.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A hydraulic cylinder cushion device installed in a hydraulic cylinder, in which a rod performs reciprocating movement in a cylinder tube and which discharges high-pressure hydraulic fluid that is formed in pressure chambers between a piston and a head cover and between the piston and a cover end during a stroke-end operation, the hydraulic cylinder cushion device comprising a check ring which is installed in a groove provided on an inner surface of a cushion ring that is provided on an outer surface of the rod and moves to one side in the groove so as to close a flow path during rushing into a stroke end while it moves to the other side in the groove so as to open the flow path during an initial operation in the stroke end.

2. The hydraulic cylinder cushion device according to claim 1, wherein the check ring is formed in grooves provided on the inner surface of the cushion ring provided on the outer surface of the rod.

3. The hydraulic cylinder cushion device according to claim 2, wherein the check ring includes:

an inner peripheral surface on which a plurality of first grooves are formed in forward and backward directions;

a sealing surface evenly formed to perform surface contact; and a step surface on which a plurality of second grooves are formed in a radial direction and which has steps formed on an opposite side of the sealing surface;

wherein during rushing into the stroke end, the sealing surface moves on one side of the groove to close a flow path, and during an initial operation, the step surface moves to the other side of the groove to open the flow path.

* * * * *